US010775088B2

(12) United States Patent
Mitchell

(10) Patent No.: US 10,775,088 B2
(45) Date of Patent: Sep. 15, 2020

(54) ICE MAKING ASSEMBLY COUPLING

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 160 days.

(21) Appl. No.: 15/898,261

(22) Filed: Feb. 16, 2018

(65) Prior Publication Data

US 2019/0257566 A1 Aug. 22, 2019

(51) Int. Cl.

| | |
|---|---|
| ***F25C 5/02*** | (2006.01) |
| ***F25D 23/10*** | (2006.01) |
| ***F25C 1/147*** | (2018.01) |
| ***F25C 5/187*** | (2018.01) |

(52) U.S. Cl.

CPC ..... *F25C 5/02* (2013.01); *F25C 1/147* (2013.01); *F25C 5/187* (2013.01); *F25D 23/10* (2013.01)

(58) Field of Classification Search

CPC ..... F25C 5/02; F25C 5/22; F25C 5/24; F25C 1/147; F25C 5/182

See application file for complete search history.

(56) References Cited

U.S. PATENT DOCUMENTS

| | | | | |
|---|---|---|---|---|
| 8,281,610 | B2 | 10/2012 | Kim et al. | |
| 9,644,878 | B2 | 5/2017 | Mitchell et al. | |
| 2011/0146325 | A1* | 6/2011 | Lee | F25C 5/22 62/344 |
| 2019/0145687 | A1* | 5/2019 | Si | F25C 5/182 |

FOREIGN PATENT DOCUMENTS

| | | |
|---|---|---|
| CN | 1940416 | 4/2007 |
| CN | 106016880 | 10/2016 |
| CN | 106016880 A | 10/2016 |
| EP | 2672206 | 12/2013 |

OTHER PUBLICATIONS

International Search Report, PCT Application No. PCT/CN2018/095187, dated Nov. 13, 2018, 4 pages.

* cited by examiner

*Primary Examiner* — Elizabeth J Martin
(74) *Attorney, Agent, or Firm* — Dority & Manning, P.A.

(57) ABSTRACT

An ice making assembly includes an ice bucket with an agitator rotatably mounted within the ice bucket. The agitator may be rotated by a dispenser motor. The agitator may be coupled to the dispenser motor via a fork connected to the motor and a socket connected to the agitator. The fork is selectively engagable with the socket, and the fork transfers torque from the dispenser motor to the agitator via the socket when the fork engages the socket. The ice making assembly may be provided in a refrigerator appliance.

20 Claims, 12 Drawing Sheets

ICE MAKING ASSEMBLY COUPLING

FIELD OF THE INVENTION

The present subject matter relates generally to ice making assemblies, such as ice making assemblies including ice makers configured to produce nugget ice, and ice dispensing systems for such ice making assemblies.

BACKGROUND OF THE INVENTION

Certain refrigerator appliances include an ice making assembly. To produce ice, liquid water is directed to an ice maker of the ice making assembly and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Ice nuggets are generally stored in an ice bucket at temperatures above the freezing temperature of liquid water to maintain a texture of the ice nuggets. An agitator is often provided in the ice bucket and a dispenser motor is provided to rotate the agitator. The agitator may be rotated within the ice bucket to urge ice nuggets from the ice bucket to a dispenser. When stored at temperatures above freezing, ice nuggets can melt and liquid water from melted ice nuggets can collect within the ice bucket. The liquid water can negatively affect performance of the refrigerator appliance and can be difficult to remove. In particular, liquid water can damage or negatively affect performance of electrical components, such as motors. Thus, many ice making assemblies position the dispenser motor above the ice bucket to avoid liquid water reaching the dispenser motor from the ice bucket.

When the dispenser motor is positioned above the ice bucket, the agitator is typically connected to the dispenser motor by interengaging gears. During operation, the agitator may be subject to significant torque, e.g., when ice nuggets become lodged in the ice bucket, particularly in corners and when partially melted nuggets clump together. In such instances, the interengaging gears may slip, producing undesirable audible effects and reduced performance of the ice dispensing system.

Accordingly, an ice dispensing system with a robust and disengagable connection between the dispenser motor and the agitator would be useful.

BRIEF DESCRIPTION OF THE INVENTION

The present subject matter includes an ice making assembly. Components of the ice making assembly may be interconnected via a coupling comprising a fork and a socket. The coupling may transfer torque when the fork and the socket are engaged. Additional aspects and advantages of the invention will be set forth in part in the following description, or may be apparent from the description, or may be learned through practice of the invention.

In a first exemplary embodiment, an ice making assembly is provided. The ice making assembly includes an ice maker configured to form ice pieces within the ice maker. The ice maker includes an ice chute to direct the ice pieces from the ice maker. The ice making assembly also includes an ice bucket defining a storage volume. The ice bucket includes an opening in communication with the ice chute to receive ice pieces into the storage volume. An agitator is rotatably mounted within the storage volume of the ice bucket. A dispenser motor is operatively coupled to a drive shaft. A socket is connected to a first end of the agitator. A fork is positioned on the drive shaft and the fork is selectively engagable with the socket. The fork transfers torque from the drive shaft to the agitator via the socket when the fork engages the socket. A lever is configured to move the fork relative to the drive shaft from an engaged position to a disengaged position. The fork clears the socket in the disengaged position such that the ice bucket may be removed from the ice making assembly when the fork is in the disengaged position.

In a second exemplary embodiment, a refrigerator appliance is provided. The refrigerator appliance includes a housing that defines a chilled chamber. An ice making assembly is disposed within the housing. The ice making assembly includes an ice maker configured to form ice pieces within the ice maker. The ice making assembly includes an ice chute to direct the ice pieces from the ice maker. The ice making assembly also includes an ice bucket defining a storage volume. The ice bucket includes an opening in communication with the ice chute to receive ice pieces into the storage volume. An agitator is rotatably mounted within the storage volume of the ice bucket. A dispenser motor is operatively coupled to a drive shaft. A socket is connected to a first end of the agitator. A fork is positioned on the drive shaft and the fork is selectively engagable with the socket. The fork transfers torque from the drive shaft to the agitator via the socket when the fork engages the socket. A lever is configured to move the fork relative to the drive shaft from an engaged position to a disengaged position. The fork clears the socket in the disengaged position such that the ice bucket may be removed from the ice making assembly when the fork is in the disengaged position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
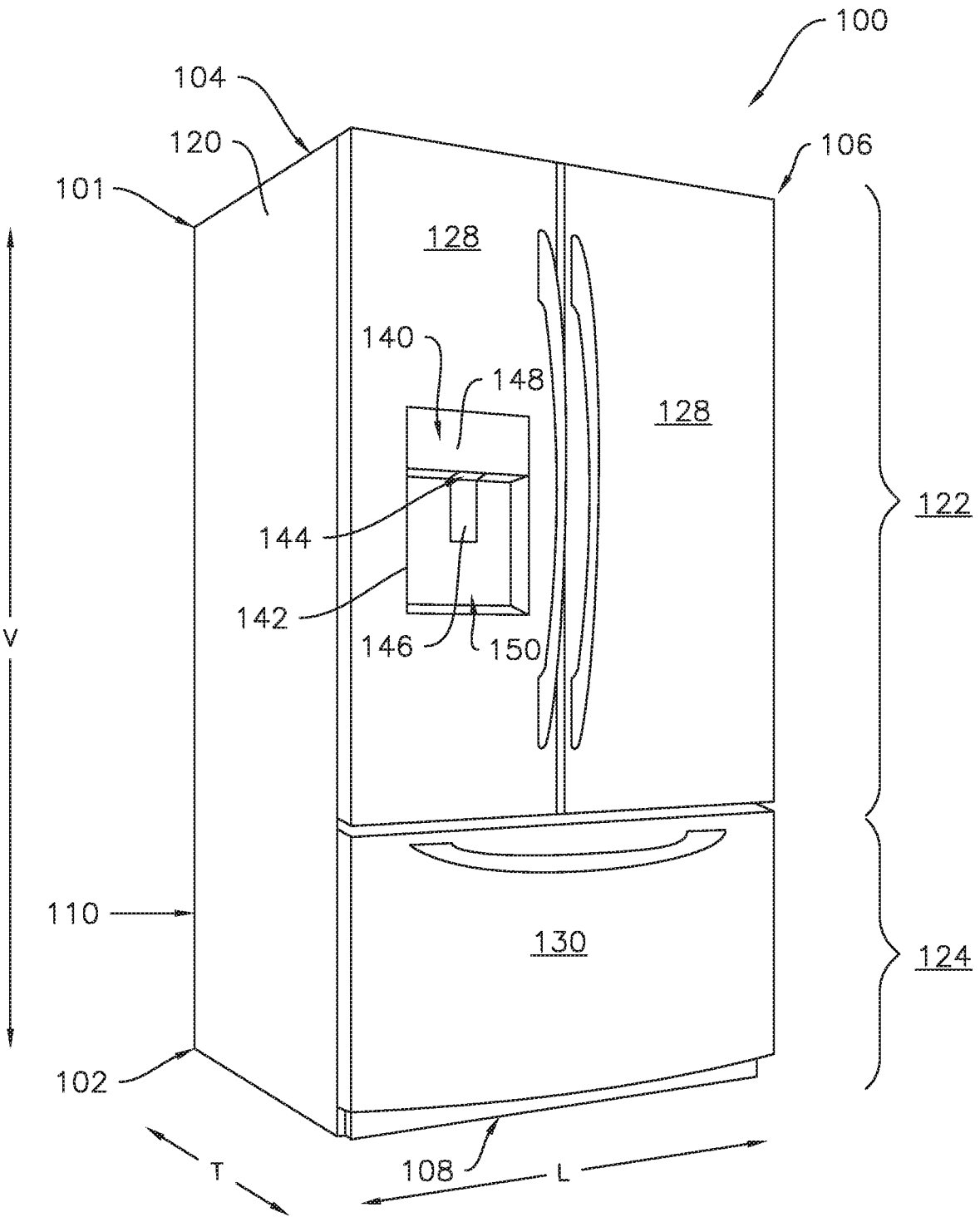
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
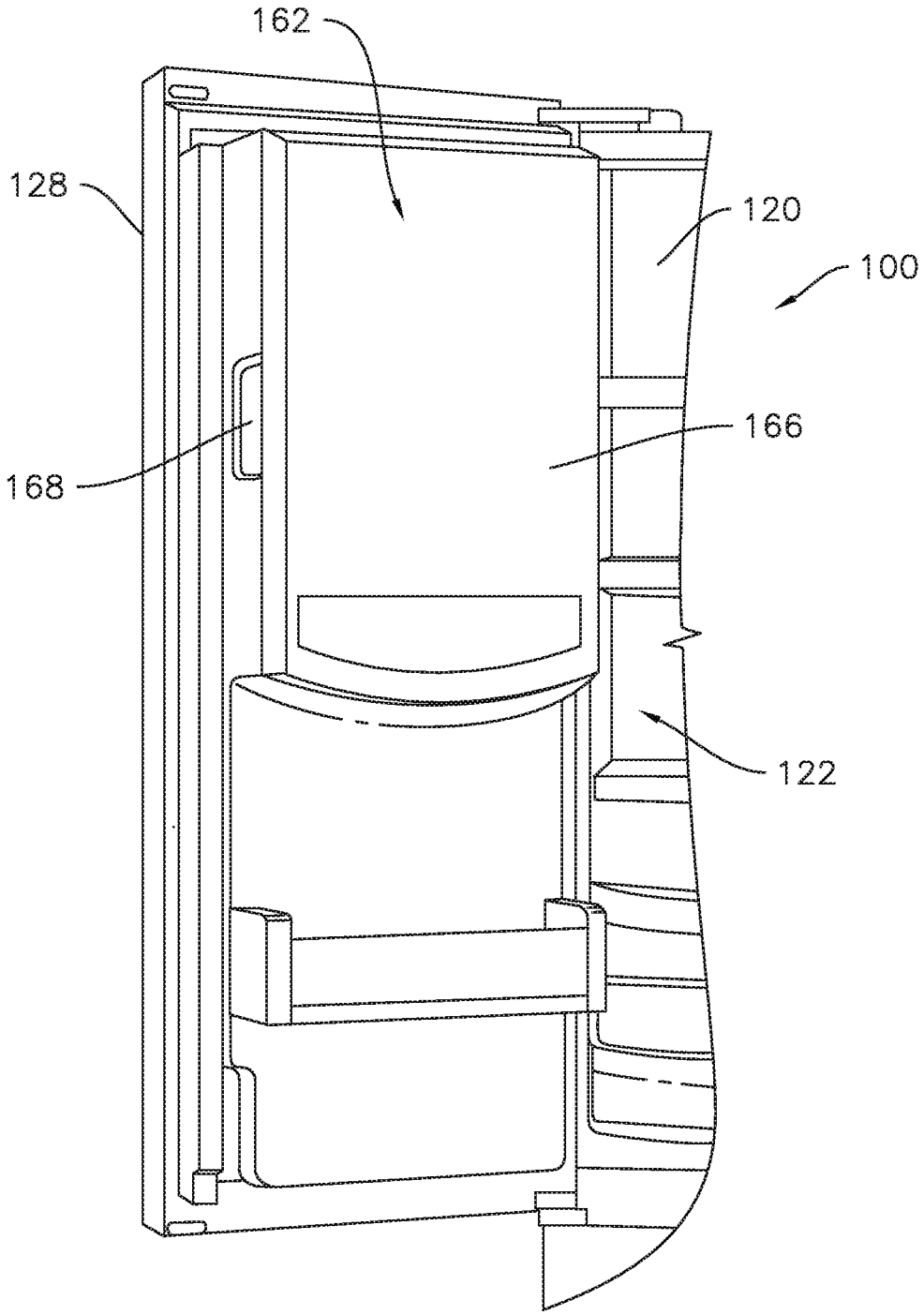
FIG. 2 provides a perspective view of a door of the exemplary refrigerator appliance of FIG. 1.

FIG. 2 provides a perspective view of a door of refrigerator doors 128. Refrigerator appliance 100 includes a sub-compartment 162 defined on refrigerator door 128. Sub-compartment 162 may be referred to as an "icebox." Sub-compartment 162 extends into fresh food chamber 122 when refrigerator door 128 is in the closed position. As discussed in greater detail below, an ice making assembly 158 including an ice maker 160 and an ice storage bin or ice bucket 164 (FIG. 3) may be positioned or disposed within sub-compartment 162. The ice maker 160 may be configured to form ice pieces, e.g., ice nuggets as described below, within the ice maker 160. The ice maker 160 may be in communication with the ice bucket 164 such that ice pieces, e.g., nuggets, formed in the ice maker 160 may be transferred to and stored in the ice bucket 164. Thus, ice is supplied to dispenser recess 150 (FIG. 1) from the ice bucket 164 in sub-compartment 162 on a back side of refrigerator door 128. Chilled air from a sealed system (not shown) of refrigerator appliance 100 may be directed into components within sub-compartment 162, e.g., ice maker 160 and/or ice bucket 164. In certain exemplary embodiments, a temperature of air within sub-compartment 162 may correspond to a temperature of air within fresh food chamber 122, such that ice within ice bucket 164 melts over time.

An access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162, e.g., by thermally isolating or insulating sub-compartment 162 from fresh food chamber 122.

Figure 3:
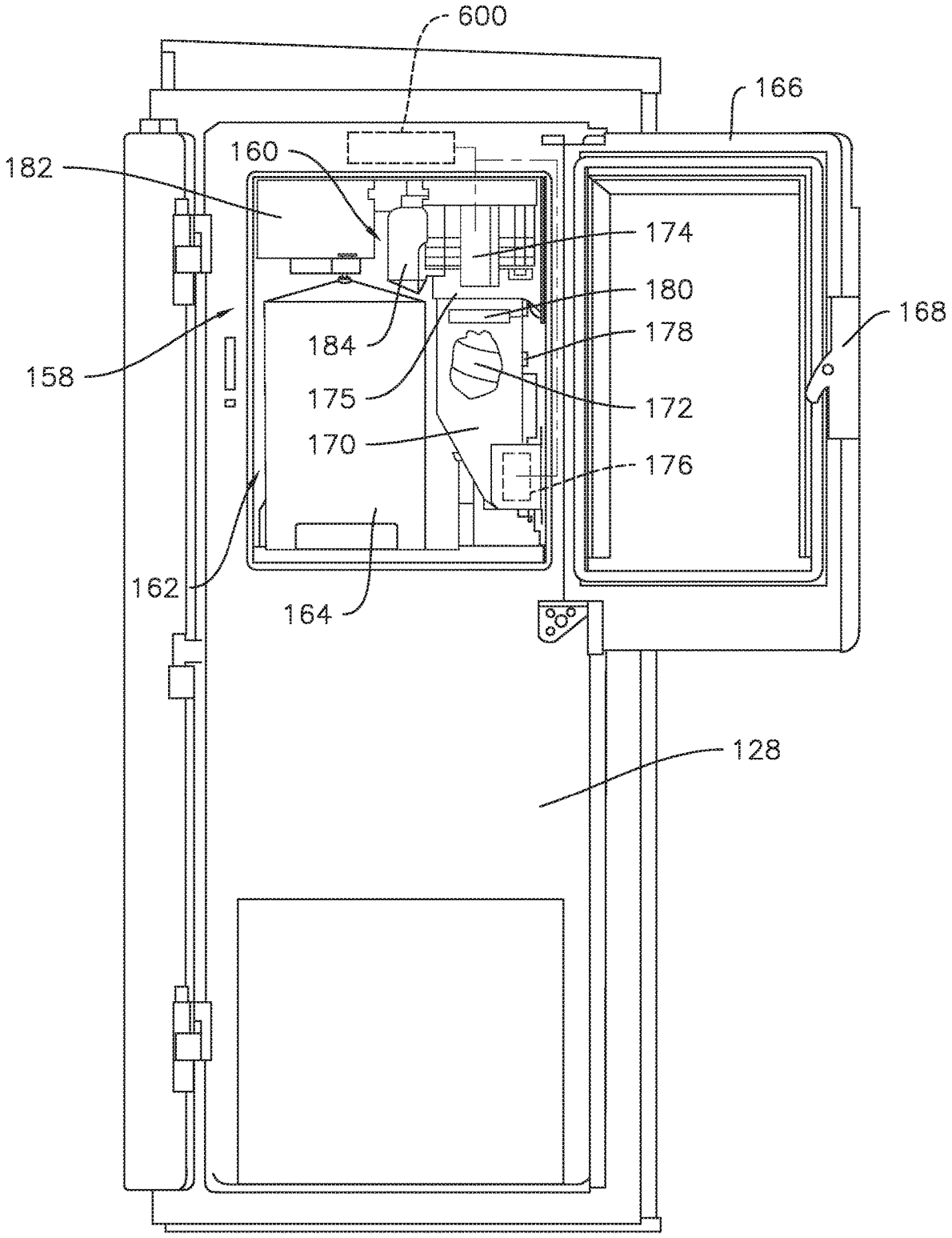
FIG. 3 provides an elevation view of the door of the exemplary refrigerator appliance of FIG. 2 with an access door of the door shown in an open position.

FIG. 3 provides an elevation view of refrigerator door 128 with access door 166 shown in an open position. As may be seen in FIG. 3, ice making assembly 158 is positioned or disposed within sub-compartment 162. As mentioned above, ice maker 160 may be configured to form ice nuggets therein. Accordingly, in the illustrated example, ice maker 160 includes a casing 170. An auger 172 is rotatably mounted in a mold body within casing 170 (shown partially cutout to reveal auger 172). In particular, an ice maker motor 174 is mounted to casing 170 and is in mechanical communication with (e.g., coupled to) auger 172. Ice maker motor 174 is configured for selectively rotating auger 172 in the mold body within casing 170. During rotation of auger 172 within the mold body, auger 172 scrapes or removes ice off an inner surface of the mold body within casing 170 and directs such ice to an extruder 175. At extruder 175, ice nuggets are formed from ice within casing 170. The extruder 175 may be in communication with an ice chute 184 to direct ice nuggets formed in the extruder 175 from the extruder 175 to an ice bucket 164. The ice bucket 164 is positioned below ice chute 184 and receives the ice nuggets from extruder 175 via the ice chute 184.

From ice bucket 164, the ice nuggets can enter dispensing assembly 140 and be accessed by a user as discussed above. In such a manner, ice making assembly 158 can produce or generate ice nuggets and supply the same to the dispensing assembly 140. For example, an agitator 192 (see, e.g., FIG. 10) may be disposed within the ice bucket 164 for urging ice nuggets from the ice bucket 164 to the dispensing outlet 144. A dispenser motor 182 may be in mechanical communication with, e.g., operatively coupled to, the dispenser agitator 192 such that the dispenser motor 182 can drive the dispenser agitator 192 to promote movement of ice nuggets from the ice bucket 164 to the dispensing outlet 144.

Referring again to FIG. 3, ice making assembly 158 also includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice maker 160 is air cooled in order to form ice therein. Ice maker 160 also includes a heater 180, such as an electric resistance heating element, mounted to casing 170. Heater 180 is configured for selectively heating casing 170, e.g., when ice prevents or hinders rotation of auger 172 within casing 170.

Operation of ice making assembly 158 is controlled by a processing device or controller 600, e.g., that may be operatively coupled to control panel 148 for user manipulation to select features and operations of ice making assembly 158. Controller 600 can operate various components of ice making assembly 158 to execute selected system cycles and features. For example, controller 600 is in operative communication with the dispenser motor 182, ice maker motor 174, fan 176 and heater 180. Thus, controller 600 can selectively activate and operate dispenser motor 182, ice maker motor 174, fan 176 and heater 180.

Controller 600 may include a memory and microprocessor, such as a general or special purpose microprocessor operable to execute programming instructions or micro-control code associated with operation of ice making assembly 158. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 600 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 180 may be in communication with controller 600 via one or more signal lines or shared communication busses.

Ice maker 160 also includes a temperature sensor 178. Temperature sensor 178 is configured for measuring a temperature of casing 170 and/or liquids, such as liquid water, within casing 170. Temperature sensor 178 can be any suitable device for measuring the temperature of casing 170 and/or liquids therein. For example, temperature sensor 178 may be a thermistor or a thermocouple. Controller 600 can receive a signal, such as a voltage or a current, from temperature sensor 178 that corresponds to the temperature of the temperature of casing 170 and/or liquids therein. In such a manner, the temperature of casing 170 and/or liquids therein can be monitored and/or recorded with controller 600.

Figure 4:
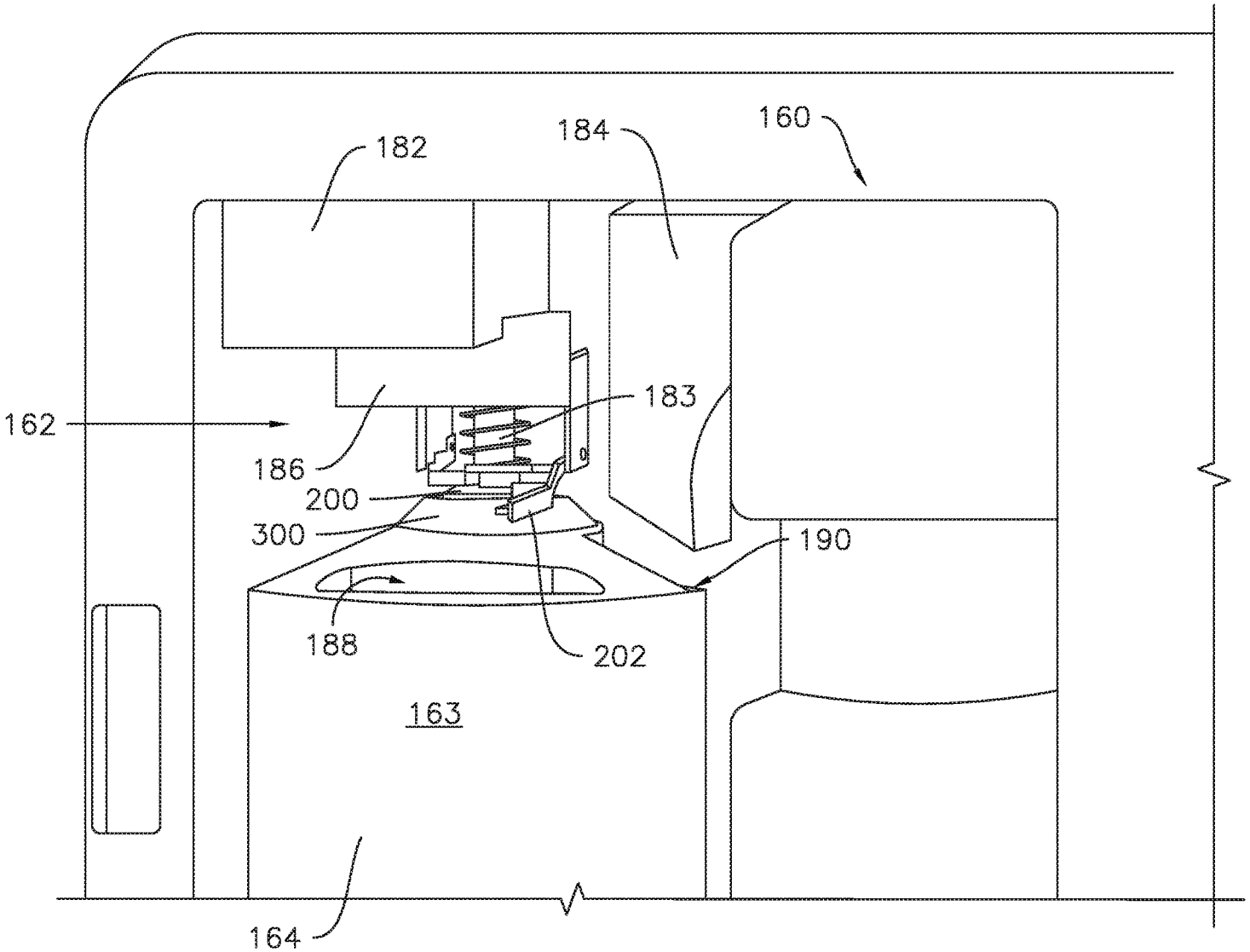
FIG. 4 provides an enlarged perspective view of a portion of the door of FIG. 3 with a fork and a socket in an engaged position.
Figure 5:
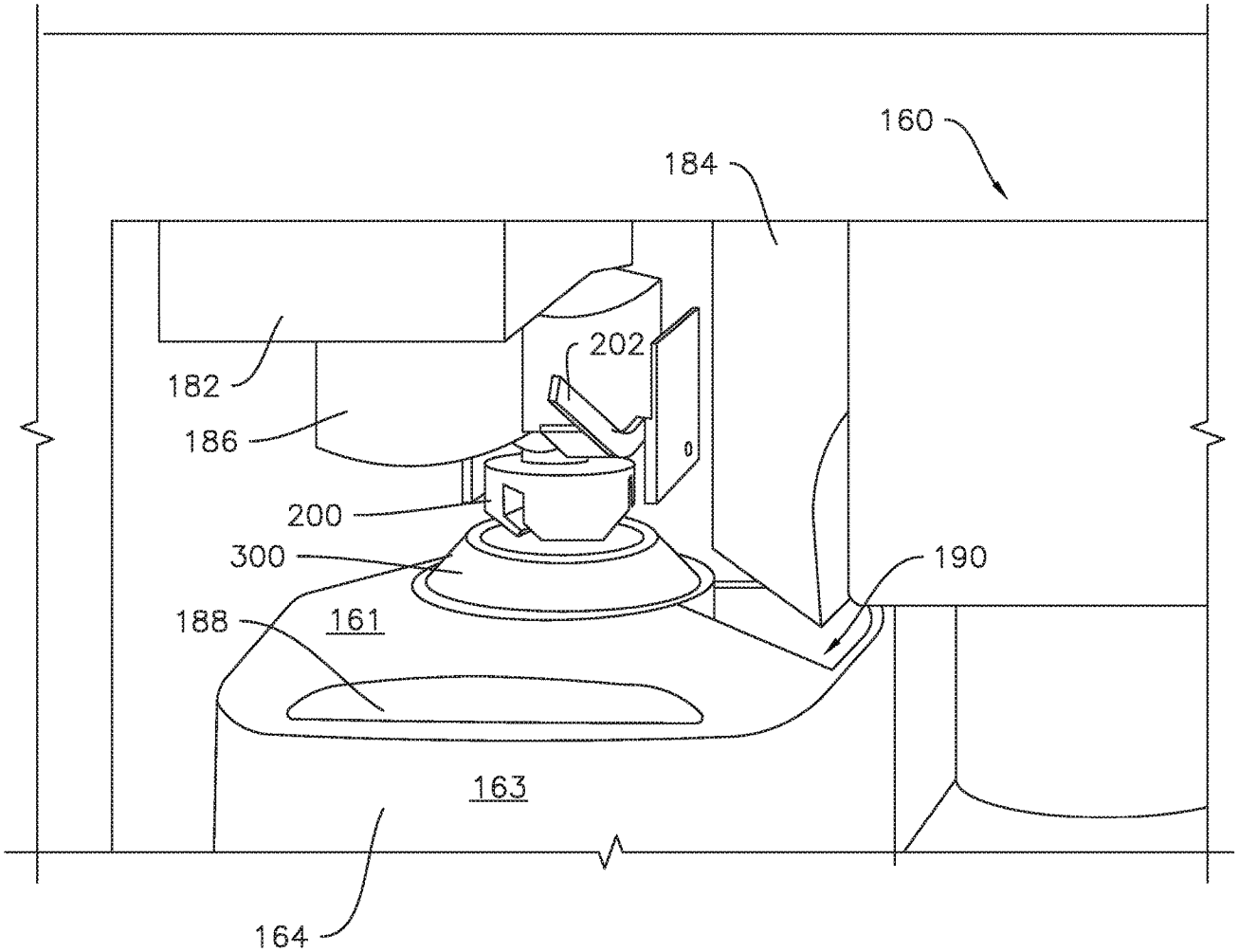
FIG. 5 provides an enlarged perspective view of a portion of the door of FIG. 3 with a fork and a socket in a disengaged position.

FIGS. 4 and 5 provide enlarged perspective views of a portion of the sub-compartment 162 of FIG. 3 and components therein. As shown in FIG. 4, the dispenser motor 182 may be operatively coupled to a drive shaft 183, e.g., via a gearbox 186. As mentioned above, dispenser motor 182 may be operatively coupled to the agitator 192. As illustrated in FIGS. 4 and 5, the dispenser motor 182 may be operatively coupled to the agitator 192 by a socket 300 connected to a first end 402 (FIG. 10) of the agitator 192 and a fork 200 positioned on the drive shaft 183. The fork 200 may be selectively engagable with and disengagable from the socket 300. When the fork 200 engages the socket 300, e.g., when the fork 200 and the socket 300 are in the engaged position illustrated in FIG. 4, the fork 200 may transfer torque from the drive shaft 183 to the agitator 192 via the socket 300. Thus, dispenser motor 182 can selectively rotate agitator 192 within ice bucket 164 when the fork 200 and the socket 300 are engaged. Rotation of agitator 192 within ice bucket 164 can assist with dispensing or removing ice nuggets from the ice bucket 164 as discussed in greater detail below. When the fork 200 disengages from the socket 300, e.g., when the fork 200 and the socket 300 are in the disengaged position illustrated in FIG. 5, the fork 200 clears the socket 300 such that the ice bucket 164 may be removed from the sub-compartment 162. A handle 188 may be integrally formed in the ice bucket 164. For example, the handle 188 may be a recessed handle or pocket handle, as illustrated in FIGS. 4 and 5. A user may grip the recessed handle 188 to assist in removing the ice bucket 164 from the sub-compartment 162 when the fork 200 and the socket 300 are in the disengaged position.

As seen in FIGS. 4 and 5, ice bucket 164 defines an opening 190, e.g., at a top portion of the ice bucket 164. When the ice bucket 164 is positioned within the sub-compartment 162, the opening 190 may be positioned below the ice chute 184 and in communication with the ice chute 184 to receive ice nuggets from the ice chute 184 into the ice bucket 164. Ice bucket 164 includes a side wall 163 and a top wall 161, a storage volume 165 (as may be seen, e.g., in FIGS. 7 and 10) is defined within the ice bucket 164 between side wall 163 and top wall 161. Opening 190 may be defined in top wall 161 and positioned (and configured) for receiving ice nuggets, e.g., from casing 170 and/or extruder 175 via ice chute 184 such that ice nuggets from ice making assembly 158 enter storage volume 165 at opening 190. The agitator 192 may be rotatably mounted within the ice bucket 164, e.g., within the storage volume 165 of the ice bucket 164.

Figure 6:
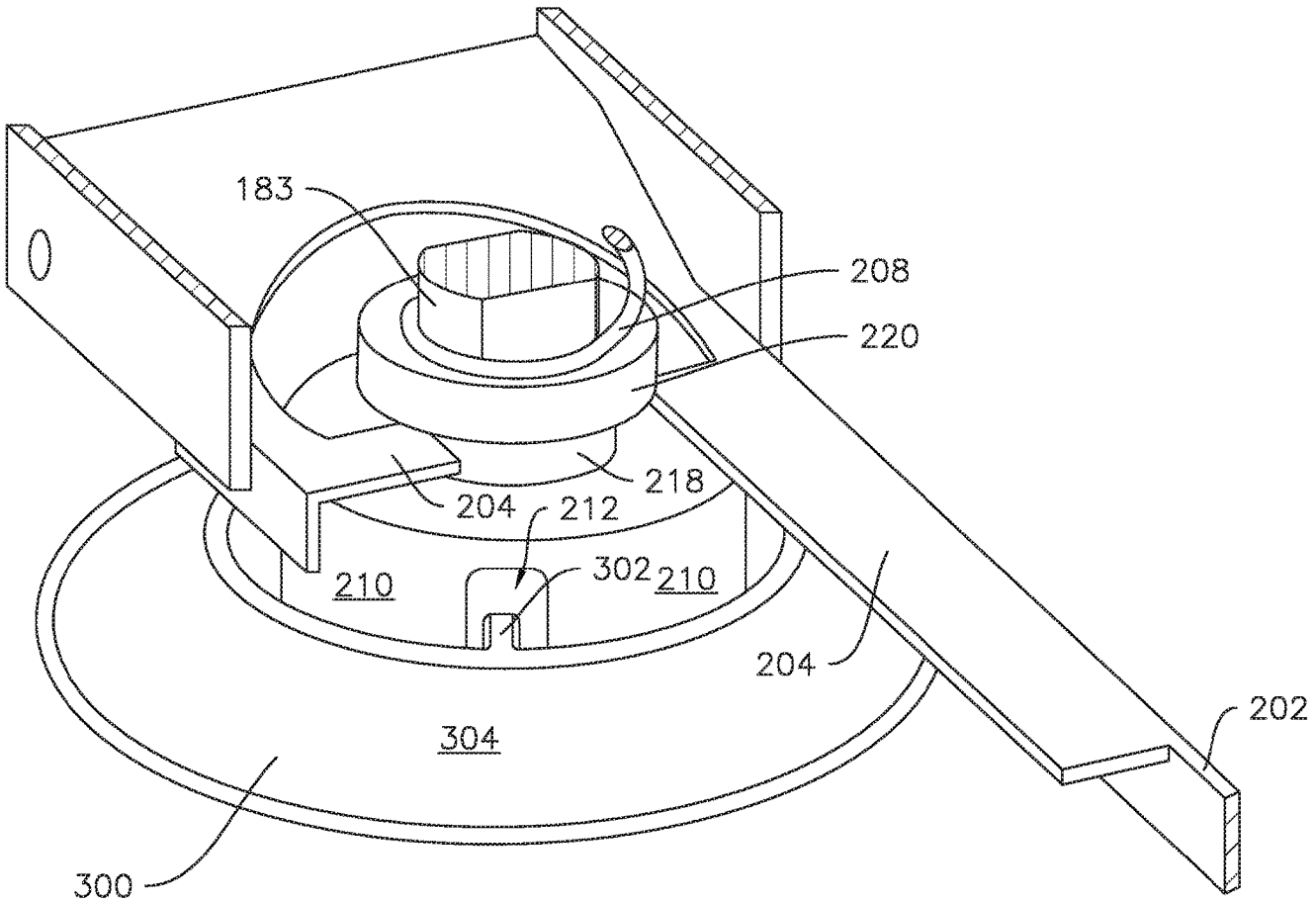
FIG. 6 provides a partially sectioned perspective view of an exemplary ice making assembly coupling according to one or more exemplary embodiments of the present subject matter.

As shown, for example, in FIG. 6, the fork 200 may include a plurality of tines 210 and one or more slots 212 defined between adjacent tines 210 of the plurality of tines 210. For example, the fork 200 may include three tines 210 and three slots 212 defined between adjacent tines 210 (see also FIGS. 11 and 12). Also shown in FIG. 6, the socket 300 may include one or more ribs 302. The ribs 302 of the socket 300 may correspond to the slots 212 of the fork 200. For example, the ribs 302 of the socket 300 may have a corresponding shape and size to the shape and size of the slots 212 of the fork 200. Such corresponding shapes and sizes may permit the ribs 302 to be received within the slots 212 with sufficient overlap between each rib 302 and the tines 210 defining the slot 212 into which the respective rib 302 is received to provide a robust connection between the fork 200 and the socket 300. For example, the connection may be sufficiently robust to transfer torque from the dispenser motor 182 to the agitator 192 via the fork 200 and the socket 300. Further, the ribs 302 of the socket 300 may correspond in number to the slots 212 of the fork 200. For example, in embodiments where the fork 200 comprises three tines 210 with three slots 212 defined between the tines 210, the socket 300 may include three ribs 302 corresponding to the three slots 212. FIG. 6 illustrates the fork 200 and the socket 300 in the engaged position, e.g., where the ribs 302 of the socket 300 are received within the slots 212 of the fork 200 when the fork 200 engages the socket 300.

Figure 7:
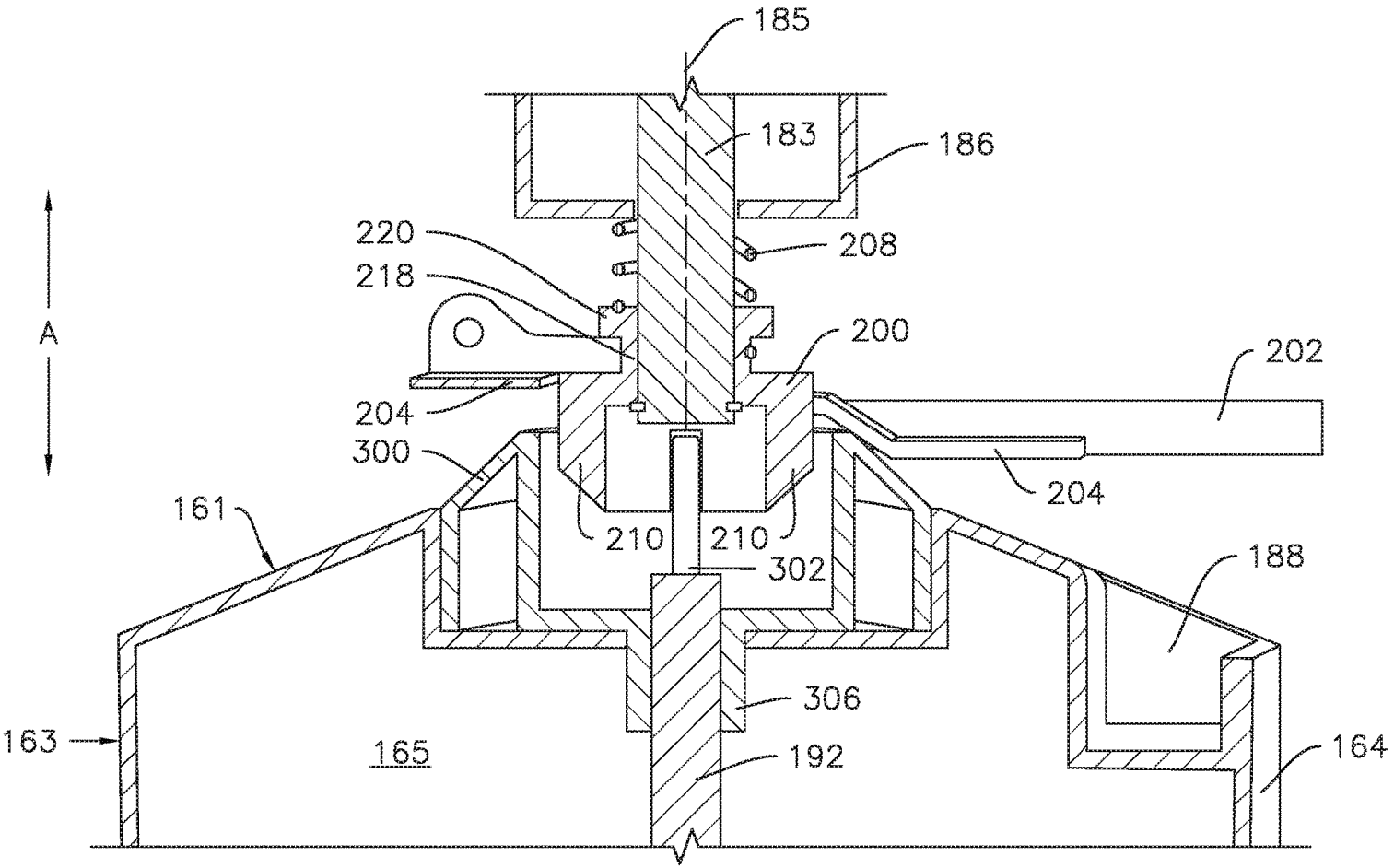
FIG. 7 provides a side section view of an exemplary ice making assembly coupling according to one or more exemplary embodiments of the present subject matter.

As shown in FIG. 7, the drive shaft 183 may include or define a longitudinal axis 185 and an axial direction A defined by the longitudinal axis 185. For example, the axial direction A may be substantially parallel to, e.g., within ten degrees in any direction of, the vertical direction V. The fork 200 may be movable relative to the drive shaft 183 along the axial direction A. For example, the fork 200 may be movable along the axial direction A between the engaged position (FIG. 4) and the disengaged position (FIG. 5). In some embodiments, a lever 202 may be provided. The lever 202 may be configured to move the fork 200 relative to the drive shaft 183 along the axial direction A from the engaged position to the disengaged position. Also as shown, e.g., in FIGS. 6 and 7, a spring 208 may be provided. The spring 208 may be configured to bias the fork 200 into engagement with the socket 300. For example, the spring 208 may bias the fork 200 towards or into the engaged position. As illustrated for example in FIGS. 6 and 7, the spring 208 may be a helical spring encircling the drive shaft 183. In some embodiments, the lever 202 and the spring 208 may selectively move the fork 200 between the engaged position and the disengaged position. For example, the lever 202 may be rotatable between a first position (FIG. 4) and a second position (FIG. 5), and the lever 202 may engage the fork 200 to move the fork 200 from the engaged position to the disengaged position when the lever 202 rotates from the first position to the second position, e.g., when a user rotates or lifts the lever 202 in order to remove the ice bucket 164 from the sub-compartment 162, e.g., to access ice nuggets stored in the ice bucket 164. The spring 208 may be compressed when the fork 200 moves from the engaged position to the disengaged position, such that the spring 208 returns the fork 200 downward along the longitudinal axis 185 of the drive shaft 183, e.g., to the engaged position, when the lever 202 is released.

The fork 200 may be in the engaged position without the fork 200 and the socket 300 being engaged, for example, when the ice bucket 164 and the socket 300 are removed from the sub-compartment 162, the spring 208 will return the fork 200 to the engaged position, but the fork 200 will not engage the socket 300 when the socket 300 is not present within the sub-compartment 162. The fork 200 may include a chamfered portion 214 (FIG. 12) and the socket 300 may include a chamfered portion 304 (FIG. 13). The respective chamfered portions 214 and 304 may be configured such that, when the ice bucket 164 is replaced within the sub-compartment 162, the chamfered portion 304 of the socket 300 will interface with the chamfered portion 214 of the fork 200. The interface will act as a ramp pushing the fork 200 upward along the axial direction A as the ice bucket 164 and attached socket 300 are inserted into the sub-compartment 164 until the ice bucket 164 is fully installed, at which point the socket 300 and the fork 200 will be aligned such that the spring 208 may bias the fork 200 into engagement with the socket 300.

Figure 8:
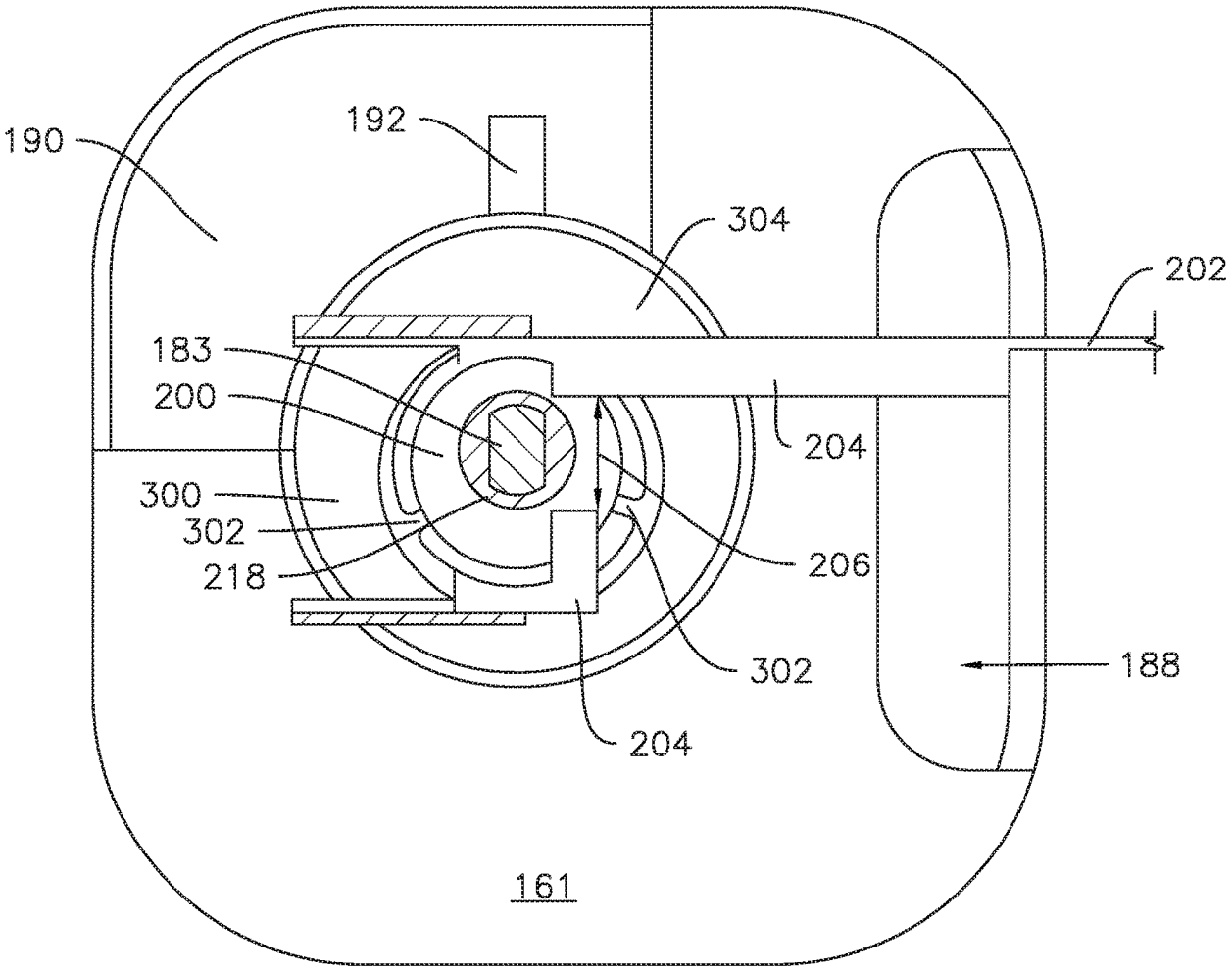
FIG. 8 provides a top section view of an exemplary ice making assembly coupling according to one or more exemplary embodiments of the present subject matter.
Figure 11:
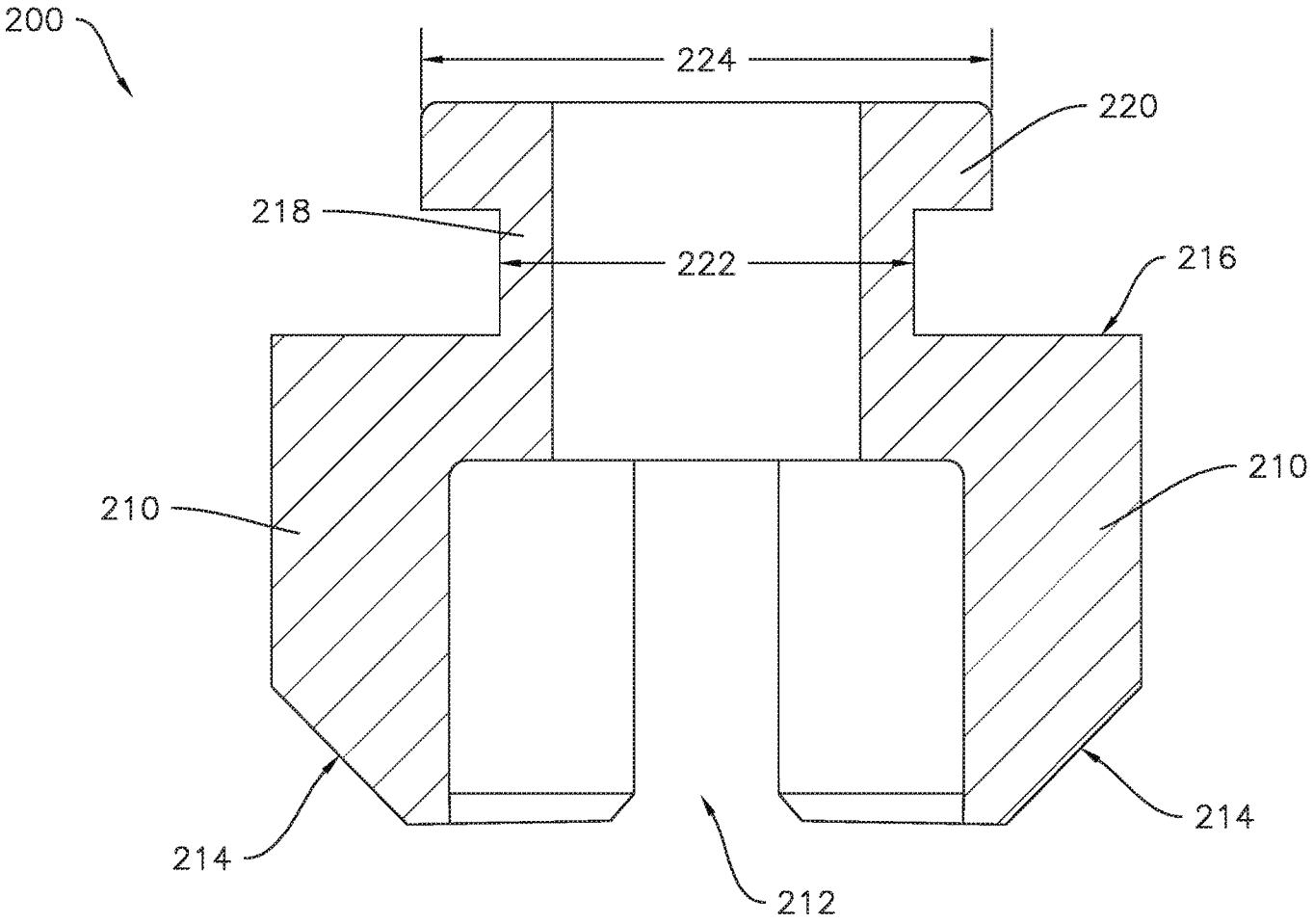
FIG. 11 provides a cross-section view of an exemplary fork according to one or more exemplary embodiments of the present subject matter.

As may be seen in FIGS. 6 and 7, the fork 200 comprises a neck 218 and a flange 220. FIG. 11 provides a cross-section view of the fork 200. As may be seen in FIG. 11, the neck 218 comprises a first outer diameter 222 and the flange 220 comprises a second outer diameter 224 greater than the first outer diameter 222 of the neck 218. FIG. 8 provides a top down section view of the exemplary coupling, with the section taken through the neck 218 of the fork 200. As may be seen in FIG. 8, the coupling may include a yoke 204 partially encircling the neck 218 of the fork 200. As noted in FIG. 8, the yoke 204 may comprise a minimum opening size or inner diameter 206. The inner diameter 206 of the yoke 204 may be greater than the first outer diameter 222 of the neck 218 of the fork 200 and less than the second outer diameter 224 of the flange 220 of the fork 200. As shown in FIGS. 4, 5, 6, and 8, the yoke 204 may be connected to the lever 202 such that the yoke 204 engages the flange 220 of the fork 200 to move the fork 200 along to the drive shaft 183 relative to the socket 300 from the engaged position to the disengaged position when the lever 202 rotates from the first position to the second position.

Figure 9:
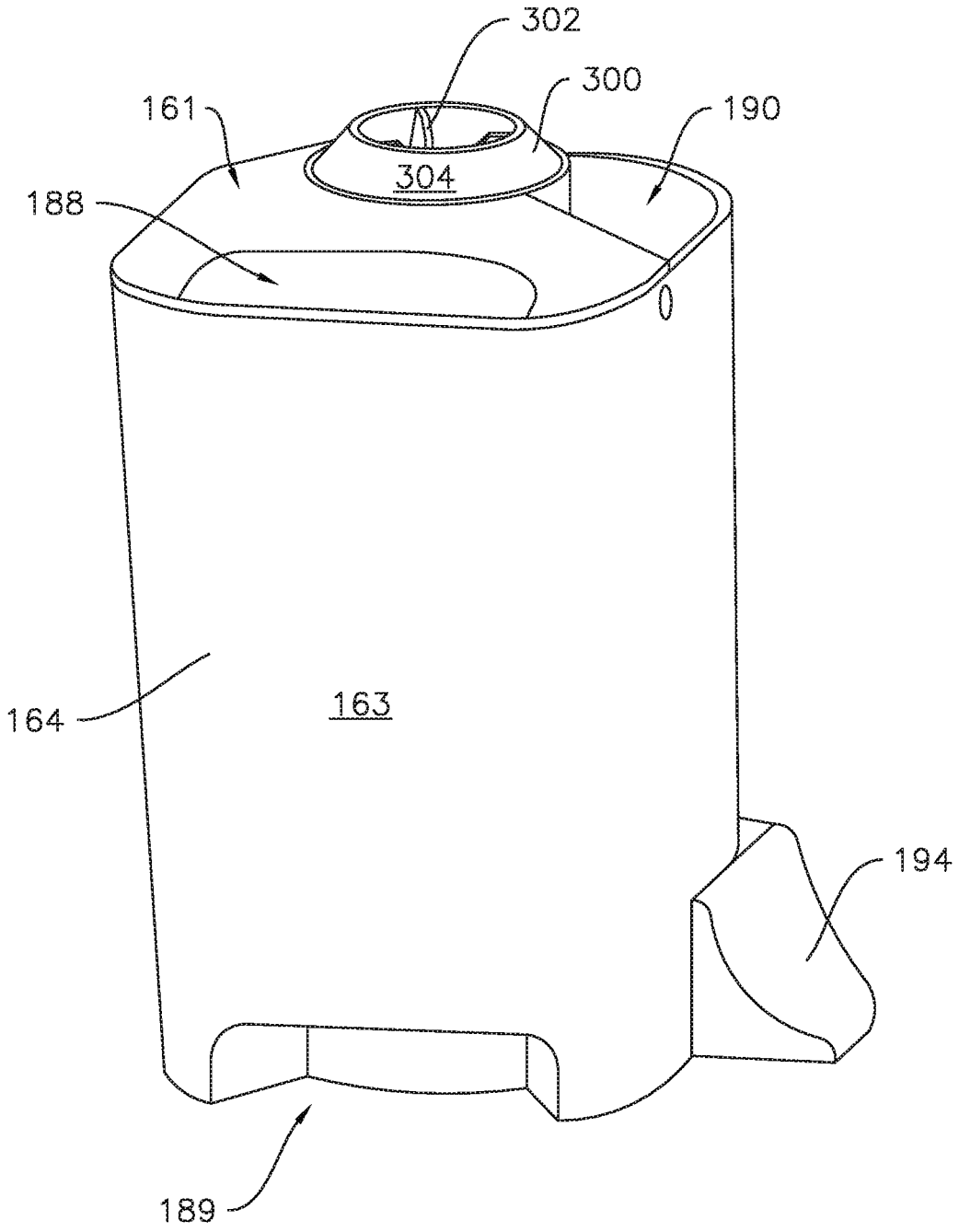
FIG. 9 provides a perspective view of an exemplary ice bucket according to one or more exemplary embodiments of the present subject matter.

FIG. 9 provides a perspective view of an exemplary ice bucket according to one or more exemplary embodiments of the present subject matter. As shown in FIG. 9, the socket 300 may be received within a recess in the top wall 161 of the ice bucket 164. As mentioned above, the ice bucket 164 may include an integral handle 188, e.g., a recessed handle, formed in or near a top portion of the ice bucket 164 to assist a user in removing the ice bucket 164 from the sub-compartment 162 when the fork 200 and the socket 300 are disengaged. As shown in FIG. 9, a second handle 189 may be integrally formed in the ice bucket 164 at or near a bottom portion of the ice bucket 164, e.g., opposite of the recessed handle 188 along the vertical direction V. Similar to handle 188, the second handle 189 may also be integrally formed in the ice bucket 164, such as a pocket handle or recessed handle.

As may be seen in FIG. 10, ice bucket 164 includes a sweep 500 positioned in a bottom portion of the ice bucket 164, e.g., below storage volume 165. Sweep 500 has sweep arms 502. An ice outlet 194 is positioned below storage volume 165, e.g., along the vertical direction V. Sweep 500 is positioned in or proximate to ice outlet 194. Sweep 500 is fixed or coupled to agitator 192, e.g., at a second end 404 of agitator 192. Thus, sweep 500 rotates when agitator 192 rotates within storage volume 165. The ice bucket 164 also includes a bottom opening 193. Bottom opening 193 is sized to permit ice nuggets from storage volume 165 to enter ice outlet 194. Thus, gravity can urge ice nuggets above opening 193 out of storage volume 165 into ice outlet 194 via bottom opening 193. Rotation of agitator 192 can assist with moving ice nuggets within storage volume 165 over bottom opening 193 such that ice nuggets move from storage volume 165 into dispensing ice outlet 194.

Ice outlet 194 is sized for directing ice nuggets out of ice bucket 164. For example, ice outlet 194 may be positioned in communication with, e.g., over, dispensing outlet 144 to direct ice nuggets from ice bucket 164 to dispensing outlet 144. For example, rotation of sweep 500 can move ice nuggets from bottom opening 193 to ice outlet 194. Thus, sweep arms 502 of sweep 500 can move ice nuggets from bottom opening 193 to ice outlet 194 during rotation of agitator 192 and sweep 500. In such a manner, ice nuggets can be dispensed from storage volume 165 without crushing the ice nuggets.

Figure 10:
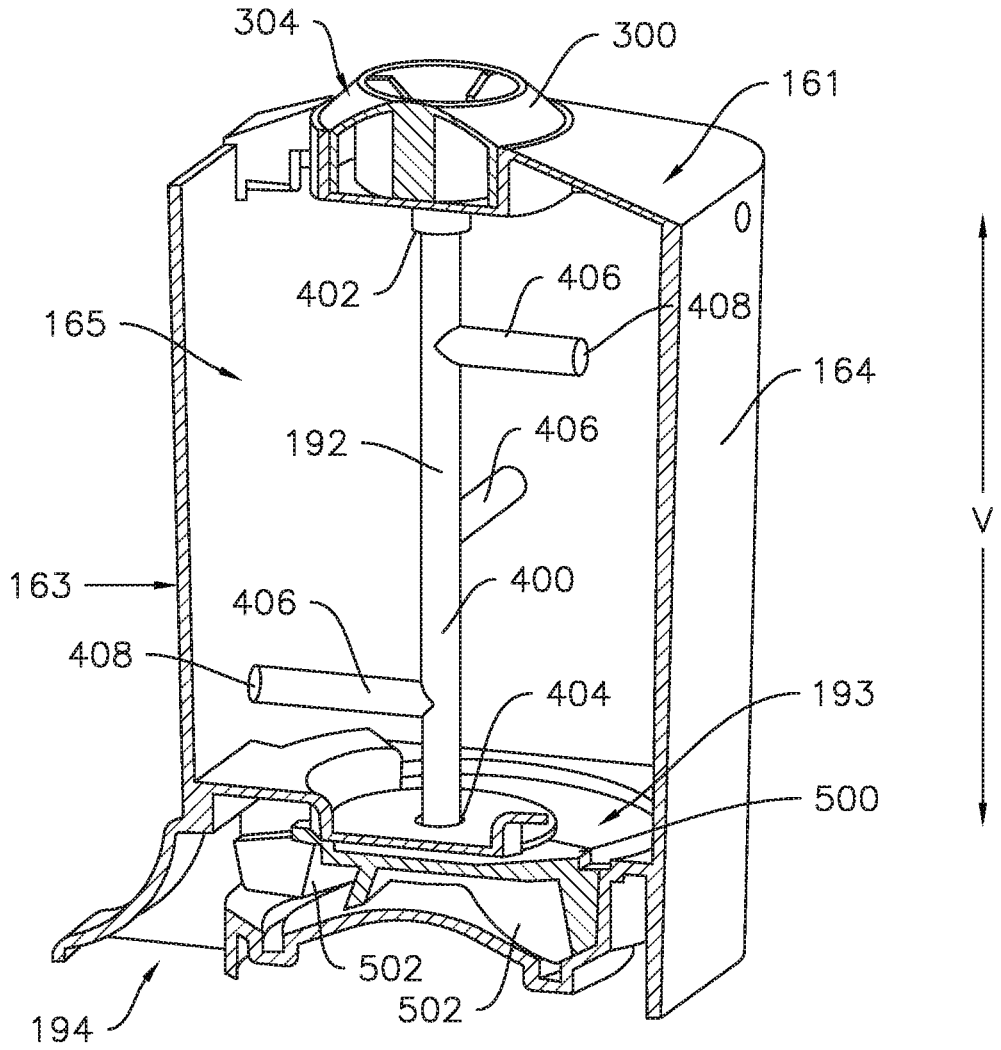
FIG. 10 provides a sectioned view of the ice bucket of FIG. 9.

As may be seen in FIG. 10, agitator 192 extends between a first end 402 and the second end 404. First and second ends 402 and 404 of agitator 192 are spaced apart from each other, e.g., along the vertical direction V when the ice bucket 164 is installed in the sub-compartment 162. First end 402 of agitator 192 may be rotatably mounted to top wall 161 of ice bucket 164, and second end 404 of agitator 192 may be rotatably mounted to a bottom wall of ice bucket 164.

As also may be seen in FIG. 10, agitator 192 includes a central post 400 with a plurality of projections 406 mounted thereto. Projections 406 are, e.g., uniformly, dispersed or distributed between first and second ends 402 and 404 of agitator 192. Thus, projections 406 are spaced apart from each other, e.g., along the vertical direction. Each of the projections 406 includes a distal end portion 408 that may be positioned adjacent or proximate sidewall 163 of ice bucket 200. Thus, projections 406 may extend, e.g., radially, from central post 400 towards sidewall 163. Projections 406 can assist with breaking up clumps of ice nuggets in storage volume 165 during rotation of agitator 192 in storage volume 165. In particular, distal end portions 408 of projections 406 can pass close to sidewall 163 and hinder accumulation or collection of ice nuggets at sidewall 163.

FIG. 11 provides a cross-section view of fork 200. As noted above, fork 200 includes a neck 218 and a flange 220. Fork 200 may also include a cylindrical or disc-shaped base portion 216. As shown in FIG. 11, the neck 218 and tines 210 may each extend from the base portion 216, with the neck 218 and the tines 210 extending in opposite directions. Moreover, the flange 220 may be formed at a distal end of the neck 218, e.g., spaced apart from the base 216 of the fork 200.

Figure 12:
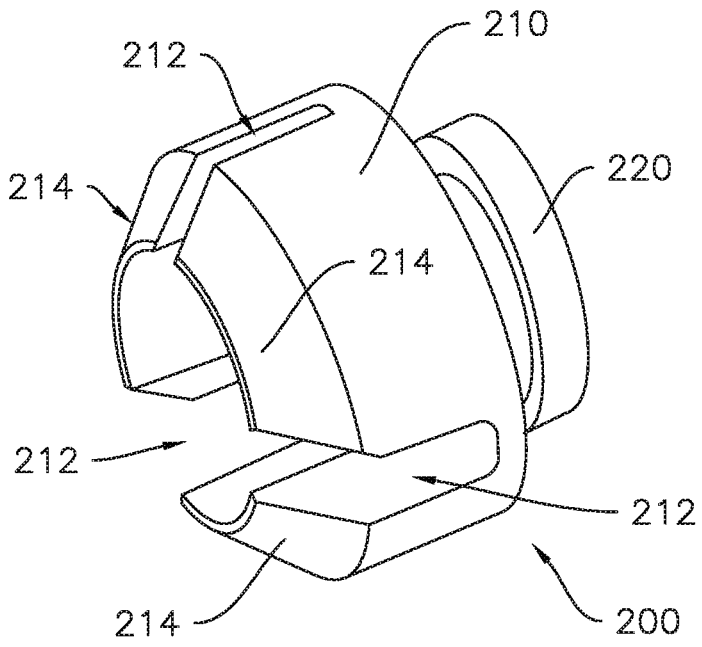
FIG. 12 provides a perspective view of an exemplary fork according to one or more exemplary embodiments of the present subject matter.
Figure 13:
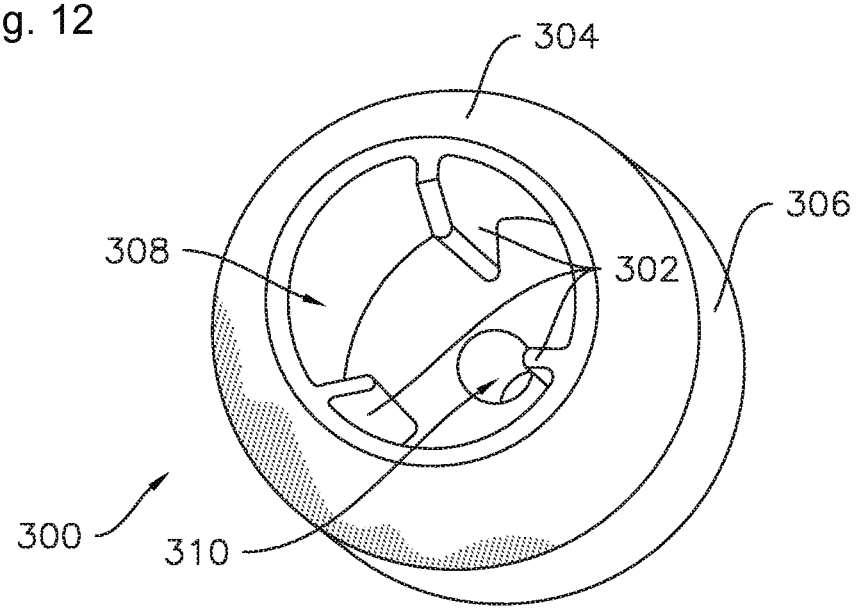
FIG. 13 provides a perspective view of an exemplary socket according to one or more exemplary embodiments of the present subject matter.

As shown in FIG. 12, the fork 200 may be generally annular. For example, each tine 210 of the fork 200 may be arcuate in form, thus each tine 210 may generally form a segment of a hollow cylinder and the chamfered portions 214 of each tine 210 may generally form segments of a frustoconical shape. For example, each of the chamfered portions 214 may taper inwardly, e.g., towards a center or central axis of the fork 200.

FIG. 13 provides a perspective view of an exemplary socket 300. As shown, the socket 300 includes a generally cylindrical main body 306 with chamfered portion 304 defining a frustoconical surface at one end of the cylindrical main body 306. The cylindrical main body 306 of the socket 300 is hollow, forming a recess 308. As shown in FIG. 13, the ribs 302 may be provided within the recess 308. For example, the ribs 302 may extend radially inward within the recess 308. Also shown in FIG. 13 is a lumen or aperture 310 formed in a bottom portion of main body 306. The first end 402 (FIG. 10) of the agitator 192 may be received within the aperture 310 when the socket 300 is connected to the agitator 192.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly, comprising:

an ice maker configured to form ice pieces within the ice maker, the ice maker including an ice chute to direct the ice pieces from the ice maker;

an ice bucket defining a storage volume, the ice bucket including an opening in communication with the ice chute to receive the ice pieces into the storage volume;

an agitator rotatably mounted within the storage volume of the ice bucket;

a dispenser motor operatively coupled to a drive shaft;

a socket connected to a first end of the agitator, the socket comprising a chamfered portion;

a fork positioned on the drive shaft, the fork comprising a chamfered portion, the fork selectively engageable with the socket, whereby the fork transfers torque from the drive shaft to the agitator via the socket when the fork engages the socket; and a lever configured to move the fork relative to the drive shaft from an engaged position to a disengaged position, wherein the fork clears the socket in the disengaged position such that the ice bucket may be removed from the ice making assembly when the fork is in the disengaged position.

2. The ice making assembly of claim 1, wherein the fork comprises a plurality of tines and one or more slots defined between adjacent tines of the plurality of tines, wherein the socket comprises one or more ribs corresponding to the slots of the fork, and the ribs of the socket are received within the slots of the fork when the fork engages the socket.

3. The ice making assembly of claim 1, wherein the drive shaft comprises a longitudinal axis, the longitudinal axis of the drive shaft defines an axial direction, and wherein the fork is movable relative to the drive shaft along the axial direction.

4. The ice making assembly of claim 3, wherein the lever is configured to move the fork relative to the drive shaft along the axial direction between the engaged position and the disengaged position.

5. The ice making assembly of claim 1, further comprising a spring, the spring biasing the fork towards the engaged position.

6. The ice making assembly of claim 1, wherein the fork comprises a neck and a flange, the neck comprising a first outer diameter and the flange comprising a second outer diameter greater than the first outer diameter of the neck, further comprising a yoke partially encircling the neck of the fork, the yoke comprising an inner diameter, the inner diameter of the yoke greater than the first outer diameter of the neck of the fork and less than the second outer diameter of the flange of the fork.

7. The ice making assembly of claim 6, wherein the lever is rotatably connected to the yoke, the lever rotatable between a first position and a second position wherein the yoke engages the flange of the fork to move the fork relative to the drive shaft from the engaged position to the disengaged position when the lever rotates from the first position to the second position.

8. The ice making assembly of claim 1, wherein the ice bucket comprises a recessed handle.

9. The ice making assembly of claim 1, wherein the dispenser motor is operatively coupled to the drive shaft via a gearbox.

10. A refrigerator appliance comprising:
a housing defining a chilled chamber;
an ice making assembly disposed within the housing, the ice making assembly comprising:
an ice maker configured to form ice pieces within the ice maker, the ice maker including an ice chute to direct the ice pieces from the ice maker;
an ice bucket defining a storage volume, the ice bucket including an opening in communication with the ice chute to receive the ice pieces into the storage volume;
an agitator rotatably mounted within the storage volume of the ice bucket;
a dispenser motor operatively coupled to a drive shaft;
a socket connected to a first end of the agitator;
a fork positioned on the drive shaft, the fork selectively engageable with the socket, whereby the fork transfers torque from the drive shaft to the agitator via the socket when the fork engages the socket, wherein the fork comprises a neck and a flange, the neck comprising a first outer diameter and the flange comprising a second outer diameter greater than the first outer diameter of the neck;
a yoke partially encircling the neck of the fork, the yoke comprising an inner diameter, the inner diameter of the yoke greater than the first outer diameter of the neck of the fork and less than the second outer diameter of the flange of the fork; and
a lever configured to move the fork relative to the drive shaft from an engaged position to a disengaged position, wherein fork clears the socket in the disengaged position such that the ice bucket may be removed from the ice making assembly when the fork is in the disengaged position.

11. The refrigerator appliance of claim 10, wherein the fork comprises a plurality of tines and one or more slots defined between adjacent tines of the plurality of tines, wherein the socket comprises one or more ribs corresponding to the slots of the fork, and the ribs of the socket are received within the slots of the fork when the fork engages the socket.

12. The refrigerator appliance of claim 10, wherein the drive shaft comprises a longitudinal axis, the longitudinal axis of the drive shaft defines an axial direction, and wherein the fork is movable relative to the drive shaft along the axial direction.

13. The refrigerator appliance of claim 12, wherein the lever is configured to move the fork relative to the drive shaft along the axial direction between the engaged position and the disengaged position.

14. The refrigerator appliance of claim 10, further comprising a spring, the spring biasing the fork towards the engaged position.

15. The refrigerator appliance of claim 10, wherein the lever is rotatably connected to the yoke, the lever rotatable between a first position and a second position wherein the yoke engages the flange of the fork to move the fork relative to the drive shaft from the engaged position to the disengaged position when the lever rotates from the first position to the second position.

16. The refrigerator appliance of claim 10, wherein the fork comprises a chamfered portion and the socket comprises a chamfered portion.

17. The refrigerator appliance of claim 10, wherein the ice bucket comprises a recessed handle.

18. The refrigerator appliance of claim 10, wherein the dispenser motor is operatively coupled to the drive shaft via a gearbox.

19. A refrigerator appliance comprising:
a housing defining a chilled chamber;
an ice making assembly disposed within the housing, the ice making assembly comprising:
an ice maker configured to form ice pieces within the ice maker, the ice maker including an ice chute to direct the ice pieces from the ice maker;
an ice bucket defining a storage volume, the ice bucket including an opening in communication with the ice chute to receive the ice pieces into the storage volume;
an agitator rotatably mounted within the storage volume of the ice bucket;
a dispenser motor operatively coupled to a drive shaft;
a socket connected to a first end of the agitator, the socket comprising a chamfered portion;
a fork positioned on the drive shaft, the fork comprising a chamfered portion, the fork selectively engageable with the socket, whereby the fork transfers torque from the drive shaft to the agitator via the socket when the fork engages the socket; and
a lever configured to move the fork relative to the drive shaft from an engaged position to a disengaged position, wherein fork clears the socket in the disengaged position such that the ice bucket may be removed from the ice making assembly when the fork is in the disengaged position.

20. The refrigerator appliance of claim 19, wherein the fork comprises a plurality of tines and one or more slots defined between adjacent tines of the plurality of tines, wherein the socket comprises one or more ribs corresponding to the slots of the fork, and the ribs of the socket are received within the slots of the fork when the fork engages the socket.

* * * * *